US012453888B2

(12) United States Patent
Syrkin et al.

(10) Patent No.: US 12,453,888 B2
(45) Date of Patent: Oct. 28, 2025

(54) SUPINE STEPPER

(71) Applicant: MEMORIAL SLOAN KETTERING CANCER CENTER, New York, NY (US)

(72) Inventors: Grigory Syrkin, New York, NY (US); Samuel Hellman, New York, NY (US)

(73) Assignee: Memorial Sloan Kettering Cancer Center, New York, NY (US)

( * ) Notice: Subject to any disclaimer, the term of this patent is extended or adjusted under 35 U.S.C. 154(b) by 226 days.

(21) Appl. No.: 18/315,952

(22) PCT Filed: Nov. 12, 2021

(86) PCT No.: PCT/US2021/059189
§ 371 (c)(1),
(2) Date: May 11, 2023

(87) PCT Pub. No.: WO2022/104095
PCT Pub. Date: May 19, 2022

(65) Prior Publication Data

US 2024/0066352 A1 Feb. 29, 2024

Related U.S. Application Data

(60) Provisional application No. 63/113,436, filed on Nov. 13, 2020.

(51) Int. Cl.

| | |
|---|---|
| ***A63B 21/00*** | (2006.01) |
| ***A63B 21/062*** | (2006.01) |
| ***A63B 23/04*** | (2006.01) |

(52) U.S. Cl.
CPC ..... *A63B 21/4045* (2015.10); *A63B 21/0628* (2015.10); *A63B 23/0417* (2013.01); *A63B 2208/0252* (2013.01)

(58) Field of Classification Search
CPC ..... A63B 21/4045; A63B 21/0628; A63B 23/0417; A63B 2208/0252; A63B 21/4011; A63B 2071/025
See application file for complete search history.

(56) References Cited

U.S. PATENT DOCUMENTS 4,781,372 A 11/1988 McCormack
5,044,355 A * 9/1991 Reopelle ..... A63B 23/0417 482/131

(Continued)

OTHER PUBLICATIONS

International Search Report on PCT PCT/US2021/059189 Dtd Mar. 8, 2022.

(Continued)

*Primary Examiner* — Andrew M Kobylarz
(74) *Attorney, Agent, or Firm* — Foley & Lardner LLP

(57) ABSTRACT

A stepper includes a base defining a horizontal plane, a first track structure coupled to the base and configured to translate along a first track, a first force receiving member coupled to the first track structure, a second track structure coupled to the base and configured to translate along a second track, a second force receiving member coupled to the second track structure, and a reciprocating mechanism coupled to the first track structure and the second track structure such that translation of the first force receiving member in a first direction causes the second force receiving member to translate in a second direction opposite the first direction.

21 Claims, 13 Drawing Sheets

(56) References Cited

U.S. PATENT DOCUMENTS

| | | | | |
|---|---|---|---|---|
| 5,108,093 | A * | 4/1992 | Watterson | A63B 22/0012 482/73 |
| 5,417,630 | A | 5/1995 | Schultz | |
| 6,152,855 | A | 11/2000 | Dean et al. | |
| 6,387,015 | B1 * | 5/2002 | Watson | A63B 23/047 482/54 |
| 9,919,183 | B1 | 3/2018 | Moschel | |
| 10,143,882 | B2 | 12/2018 | Lagree | |
| 11,890,500 | B2 * | 2/2024 | Tekerlek | A63B 22/0007 |
| 11,980,788 | B1 * | 5/2024 | Maresh | A63B 21/0615 |
| 2002/0028731 | A1 | 3/2002 | Stearns et al. | |
| 2016/0258573 | A1 | 9/2016 | Goldish et al. | |

OTHER PUBLICATIONS

International Preliminary Report on Patentability for PCT/US2021/059189 dated May 25, 2023, 10 pages.

* cited by examiner

SUPINE STEPPER

CROSS-REFERENCE TO RELATED APPLICATION

This application claims priority to U.S. Provisional Patent Application No. 63/113,436, filed Nov. 13, 2020, the content of which is hereby incorporated by reference in its entirety.

BACKGROUND

The present disclosure relates generally to the field of medical systems and devices. More specifically, the present disclosure relates generally to stepping devices to improve leg strength and mobility of a person who is oriented in a supine position.

SUMMARY

According to various embodiments, a stepper includes a base defining a horizontal plane, a first track structure coupled to the base and configured to translate along a first track, a first force receiving member coupled to the first track structure, a second track structure coupled to the base and configured to translate along a second track, a second force receiving member coupled to the second track structure, and a reciprocating mechanism coupled to the first track structure and the second track structure such that translation of the first force receiving member in a first direction causes the second force receiving member to translate in a second direction opposite the first direction.

According to various embodiments, the reciprocating mechanism is selectively coupled to the first track structure and the second track structure such that the first track structure translates independently of the second track structure when the reciprocating mechanism is decoupled from the first track structure and the second track structure. According to various embodiments, the reciprocating mechanism includes a rack and pinion mechanism. According to various embodiments, the rack and pinion mechanism includes a first engagement member coupled to the first track structure, a second engagement member coupled to the second track structure, and a gear coupled to the first engagement member and the second engagement member. According to various embodiments, the stepper includes a brake mechanism coupled to the reciprocating mechanism and configured to selectively provide a braking force to resist the translation of the first track structure and the second track structure. According to various embodiments, the brake mechanism includes an adjustment mechanism configured to adjust the braking force. According to various embodiments, the first track and the second track are substantially parallel to the horizontal plane. According to various embodiments, the stepper includes a securing member coupled to the base and configured to attach the base to a structure. According to various embodiments, the structure includes a bed. According to various embodiments, the stepper includes a weight mechanism including at least one weight, wherein the weight mechanism is coupled to at least one of the first track structure and the second track structure such that the translation of at least one of the first force receiving member and the second force receiving member causes movement of the at least one weight in a direction perpendicular to the horizontal plane. According to various embodiments, the weight mechanism is selectively coupled to at least one of the first force receiving member and the second force receiving member and the weight mechanism includes a coupling member, wherein the coupling member is configured to selectively couple the at least one weight to at least one of the first track structure and the second track structure. According to various embodiments, the stepper includes a height adjustment mechanism configured to adjust a height, wherein a vertical distance between the first track structure and a ground defines the height. According to various embodiments, the first force receiving member is rotatably coupled to the first track structure to allow for the first force receiving member to rotate relative to the first track structure while the first force receiving member translates in the first direction and wherein the second force receiving member is rotatably coupled to a second track structure to allow for the second force receiving member to rotate relative to the second track structure while the second force receiving member translates in the second direction. According to various embodiments, the first force receiving member is configured to rotate between a predetermined maximum angle and a predetermined minimum angle. According to various embodiments, the base is coupled to a plurality of wheels, at least one of the plurality of wheels includes a stopper configured to selectively engage and prevent rotation of the at least one of the plurality of wheels. According to various embodiments, the first force receiving member includes a first pedal and the second for receiving member includes a second pedal.

According to various embodiments, a method includes providing a base defining a horizontal plane, coupling a first track structure to the base, coupling a first force receiving member to the first track structure, coupling a second track structure to the base, coupling a second force receiving member to the second track structure, coupling a reciprocating mechanism the first track structure and the second track structure, and applying a first force to the first force receiving member causing the first track structure to translate along a first track in a first direction and the second track structure to translate along a second track in a second direction opposite the first direction. According to various embodiments, the method includes decoupling reciprocating mechanism from the base such that the first track structure translates independently of the second track structure. According to various embodiments, the reciprocating mechanism includes a rack and pinion mechanism. According to various embodiments, the reciprocating mechanism is coupled to a brake mechanism configured provide a braking force to resist translation of the first force receiving member and the second force receiving member. According to various embodiments, the method includes adjusting an angle of the first force receiving member between a predetermined maximum angle and a predetermined minimum angle. According to various embodiments, the method includes coupling a weight to at least one of the first track structure and the second track structure such that translation of at least one of the first force receiving member and the second force receiving member causes movement of the weight in a direction perpendicular to the horizontal plane. According to various embodiments, the weight is selectively coupled to at least one of the first force receiving member and the second force receiving member, and wherein a coupling member is configured to selectively couple the weight to at least one of the first track structure and the second track structure.

According to various embodiments, a stepper includes a base defining a horizontal plane, a first track structure coupled to the base and substantially parallel to the horizontal plane, a first force receiving member coupled to the first track structure and configured to translate along the first track structure, a second track structure coupled to the base and substantially parallel to the horizontal plane, a second force receiving member coupled to the second track structure and configured to translate along the second track structure, and a weight coupled to at least one of the first force receiving member and the second force receiving member such that translation of at least one of the first force receiving member and the second force receiving member causes movement of the weight in a direction perpendicular to the horizontal plane.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
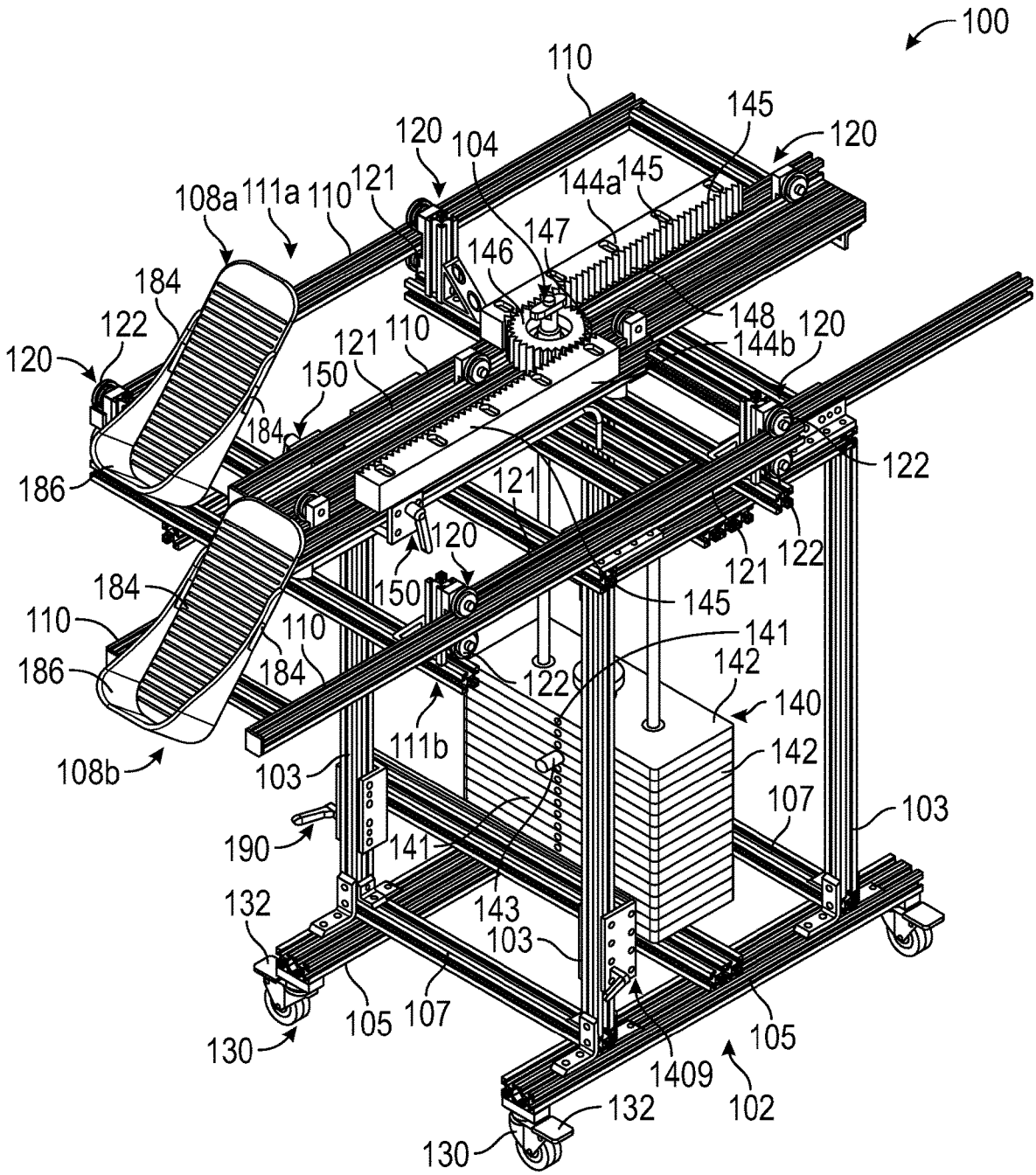
FIG. 1 is a perspective view of a supine stepper, according to an embodiment.
Figure 2:
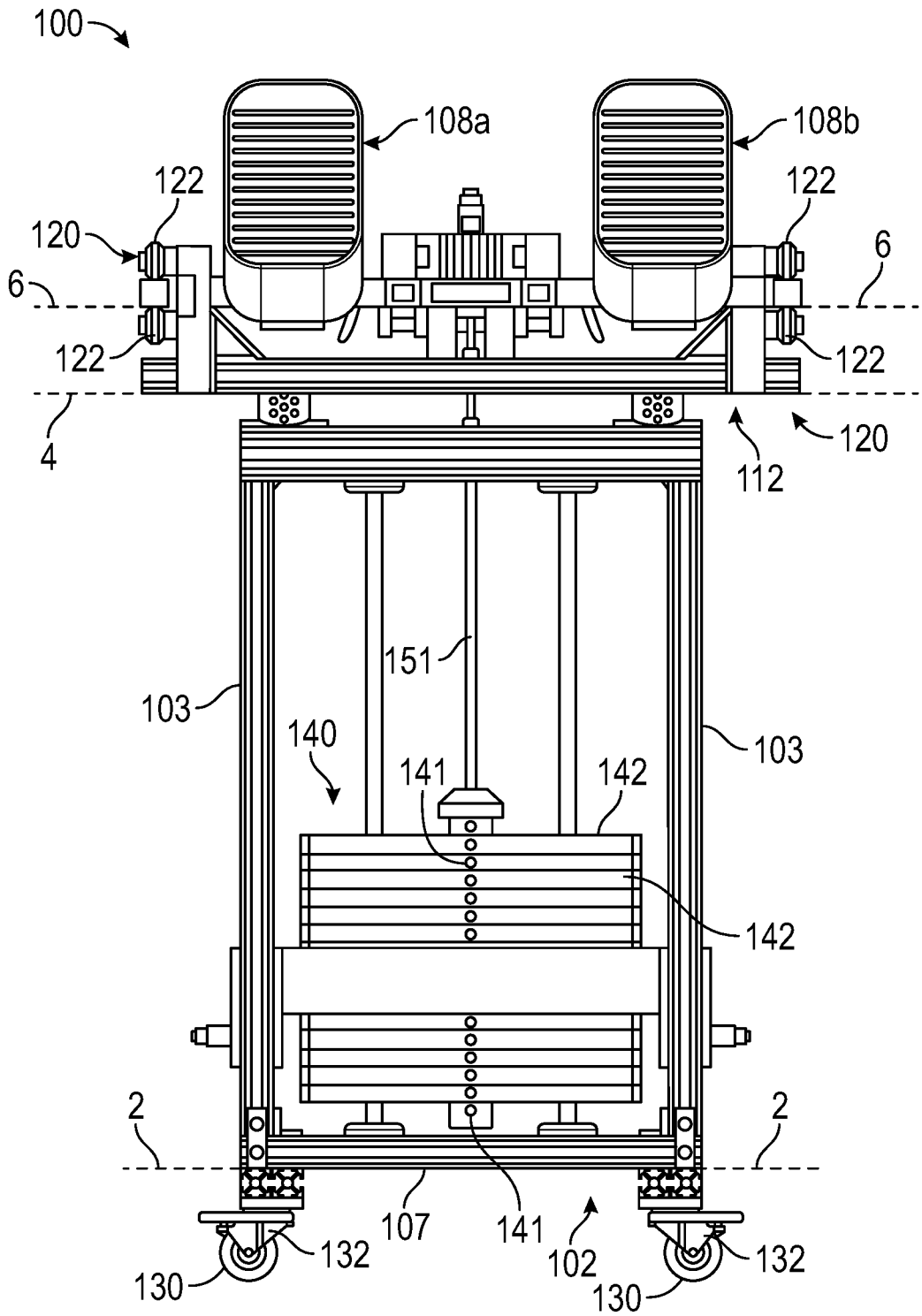
FIG. 2 is a front view of the supine stepper of FIG. 1.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Hospital-acquired deconditioning and weakness are a significant problem for both cancer and non-cancer patients alike. Following severe illness patients may be unable to move and require the help of multiple people for even the most basic tasks, such as turning in bed. Often the difficulty stems not only from loss of muscle, but also from limb swelling and joint stiffness. One of the first movements that must be regained is the ability to slide a leg up and down the bed, engaging both hip and knee joints at the same time. When a patient is unable to perform this movement (the heel slide) under their own power, the leg is moved up and down by a nurse or a physical therapist, which can be quite taxing if the limb is heavy or if there is a significant amount of stiffness. Motorized recumbent cycling systems cost several thousand dollars and occupy a significant amount of space, making them impractical for a wide use outside of special settings, such as intensive care units (ICUs).

At this time there are no portable devices that can be deployed by a single individual to help a severely deconditioned patient practice performing a heel slide and its reciprocal, the leg press. Embodiments of the present disclosure relate generally to a stepper system that can be utilized by a person lying in a supine position (e.g., horizontally, parallel to a floor surface, etc.). The stepper system works in a horizontal plane and uses the weight of one limb (e.g., leg) to drive the other via a reciprocating mechanism, thus allowing even very weak patients to practice a movement that is instrumental in regaining basic mobility.

Referring to the figures generally, various supine steppers (e.g., supine steppers 100, 200, 300, 400) are disclosed, according to various example embodiments. The supine steppers have the capacity to drive one leg up via applied force by the patient and, as needed, external assistance by the treating therapist. In another embodiment, the supine steppers may include additional components such as resistance devices (e.g., external weight, hydraulic cylinder, elastic bands, springs, friction) allowing different loads to be applied each side of the supine stepper, instruments that measure the work output based on the force applied to the supine stepper by a patient, and an electrical generator or other components to generate electricity and provide a visual display of the effort produced by the exercising subject.

Among other benefits, the supine stepper allows linear motion of a person's leg, simulating part of the extension action necessary to stand up. Another beneficial aspect of the supine stepper is reciprocal motion capability, allowing the weight of one leg to drive the other, so that even the most debilitated patients can use the device without overexertion. In some embodiments, the supine stepper includes additional features and functionality. For example, the supine stepper may include a resistance mechanism to engage one leg at a time. The automatic return device (e.g., a weight mechanism, elastic strap, spring, linear driver, etc.) can be used to vary the resistance provided to a single leg, or may be included to provide resistance to both legs during actuation. In one embodiment, the resistance mechanism includes a weight stack (e.g., individual weights, etc.) that allows for variation in the resistance/return force provided to each pedal. The weight stack may be coupled to the pedal via a cable to transfer the force of the weight stack under gravity to the pedal. Among other benefits, using a weight stack eliminates failure modes that may occur when using elastic or spring materials (rupture, etc.), may be more easily cleaned, and provides a more uniform application of force than elastic elements such as springs and elastic tubing/straps. The supine stepper may integrate all of this functionality into a single device that can be deployed by a single person.

In one embodiment, the supine stepper may be configured to convert between different functional implementations. For example, the supine stepper may be configured to convert from a reciprocal movement function in which one leg drives movement of the other (e.g., in which there is coordinated movement between two legs) and an isolated movement function in which the supine stepper engages a single leg. In one aspect, each pedal is detachably coupled to the reciprocating mechanism and can be disengaged from the reciprocating mechanism to provide the isolated movement function. In one embodiment, the supine stepper can be modified so that the reciprocating mechanism (e.g., gear, cog, pulley wheel, etc.) is selectively disengagable from both pedals and each pedal can move independently from the reciprocating mechanism. In another embodiment, the pedals may optionally link together and operate as a leg press that can be engaged by both of a patient's legs simultaneously (e.g., both pedals move together in the same direction).

In some embodiments, the supine stepper may include electronically controlled actuators and a control system to facilitate positioning of the pedals with respect to each other and the base, to vary the resistive force applied to each pedals, to vary the extension distance of the pedals, to establish a training plan for the patient (e.g., a variation in the resistance over time, etc.), and/or to deploy the supine stepper. The control system may also include sensors to monitor patient progress (e.g., force applied, intensity, etc.) with using the supine stepper.

According to various embodiments, the supine steppers described herein include: (1) the ability to apply force in a horizontal direction to facilitate rehabilitation of bed-bound patients; (2) the ability to provide reciprocal motion between two legs; (3) an articulating foot platform that allows appropriate anatomic alignment of the limb, resulting in a more functional pattern of leg muscle activation; (4) the ability to bring leg closer to neutral hip alignment; (5) the ability to provide a uniform level of resistance (e.g., via a weight stack) to the pedals (as compared to a spring, which may not provide a perfectly linear application of force as the leg gets closer to full extension, a condition which is opposite of how human body works); (6) integration into a single device that can be deployed without the need for multiple nurses/technicians; and/or (7) the ability to work limbs reciprocally or independently or jointly with or without added resistance.

Among other benefits, the supine stepper of the present disclosure will improve the efficiency of restorative therapy delivery, as only one therapist would be needed to provide a functionally meaningful exercise to a bed-bound patient.

Referring to FIGS. 1-4, a supine stepper 100 is shown, according to an example embodiment. The supine stepper 100 is configured to provide coordinated movement of a patient's legs while the patient is oriented in a supine position (e.g., horizontally, parallel to a floor surface, while lying on a bed, etc.). The supine stepper 100 includes a base 102 comprising a plurality of horizontal support structures 105, 107 coupled to one another. The base 102 defines a horizontal plane 2 (see FIGS. 2 and 3). According to various embodiments, the horizontal plane 2 is parallel to the surface (e.g., ground, floor, etc.) that the supine stepper 100 is supported by. According to some embodiments, the horizontal plane 2 is substantially parallel (e.g., within 10 degrees, within 5 degrees, etc.)) of the surface. The supine stepper 100 further includes a plurality of wheels 130 (e.g., casters) such that the supine stepper 100 can be moved and repositioned without the need to lift up the supine stepper 100. Further, as shown, the supine stepper 100 includes a plurality of stoppers 132 coupled to each wheel 130. The stoppers 132 are configured to selectively engage each wheel 130 to prevent rotation of the wheel (e.g., to prevent incidental movement of the supine stepper 100). For example, the stoppers 132 may be pressed (e.g., stepped on) to engage the wheels 130 when the supine stepper 100 is in use to prevent the supine stepper 100 from rolling away from the user of the supine stepper 100.

As shown, the supine stepper 100 includes a plurality of vertical support structures 103 coupled to the base 102. The vertical support structures 103 are substantially perpendicular (e.g., within 10 degrees, within 5 degrees, etc.) to the horizontal plane 2 and elevate a platform 112 of the supine stepper 100 such that the supine stepper 100 may be used while the user is positioned on an elevated surface (e.g., a bed, a couch, etc.). According to various embodiments, the platform 112 defines a plane 4. As shown, the plane 4 is parallel to the horizontal plane 2. According to other embodiments, the plane 4 is substantially parallel to the horizontal plane 2 (e.g., within 10 degrees, within 5 degrees, etc.). However, according to various embodiments, the plane 4 may be angled (e.g., to accommodate a user positioned on an angled surface).

According to various embodiments, the horizontal position of the platform 112 (e.g., the position of the platform within the plane 4) may be controllably adjusted. For example, as shown, the supine stepper 100 includes adjustment mechanisms 150 that are configured to selectively engage the platform 112. The adjustment mechanisms 150 are configured to transition from an unlocked orientation to a locked orientation. When the adjustment mechanisms 150 are in the unlocked orientation, the platform 112 may be translate relative to the base 102 to adjust the horizontal position of the platform 112. When the adjustment mechanisms 150 are in the locked orientation, the horizontal position of the platform 112 relative to the base 102 may be fixed.

Figure 3:
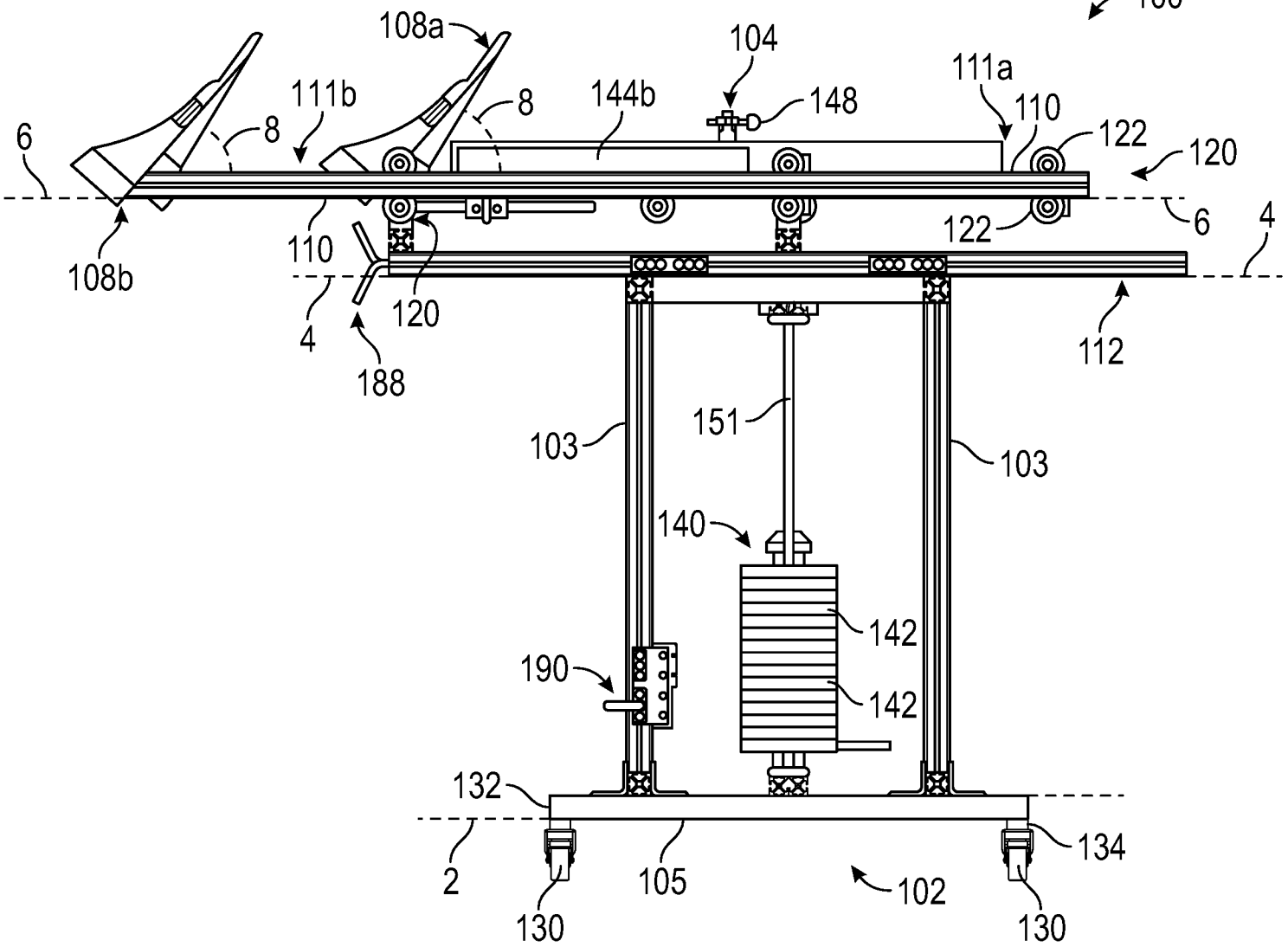
FIG. 3 is a side view of the supine stepper of FIG. 1.
Figure 4:
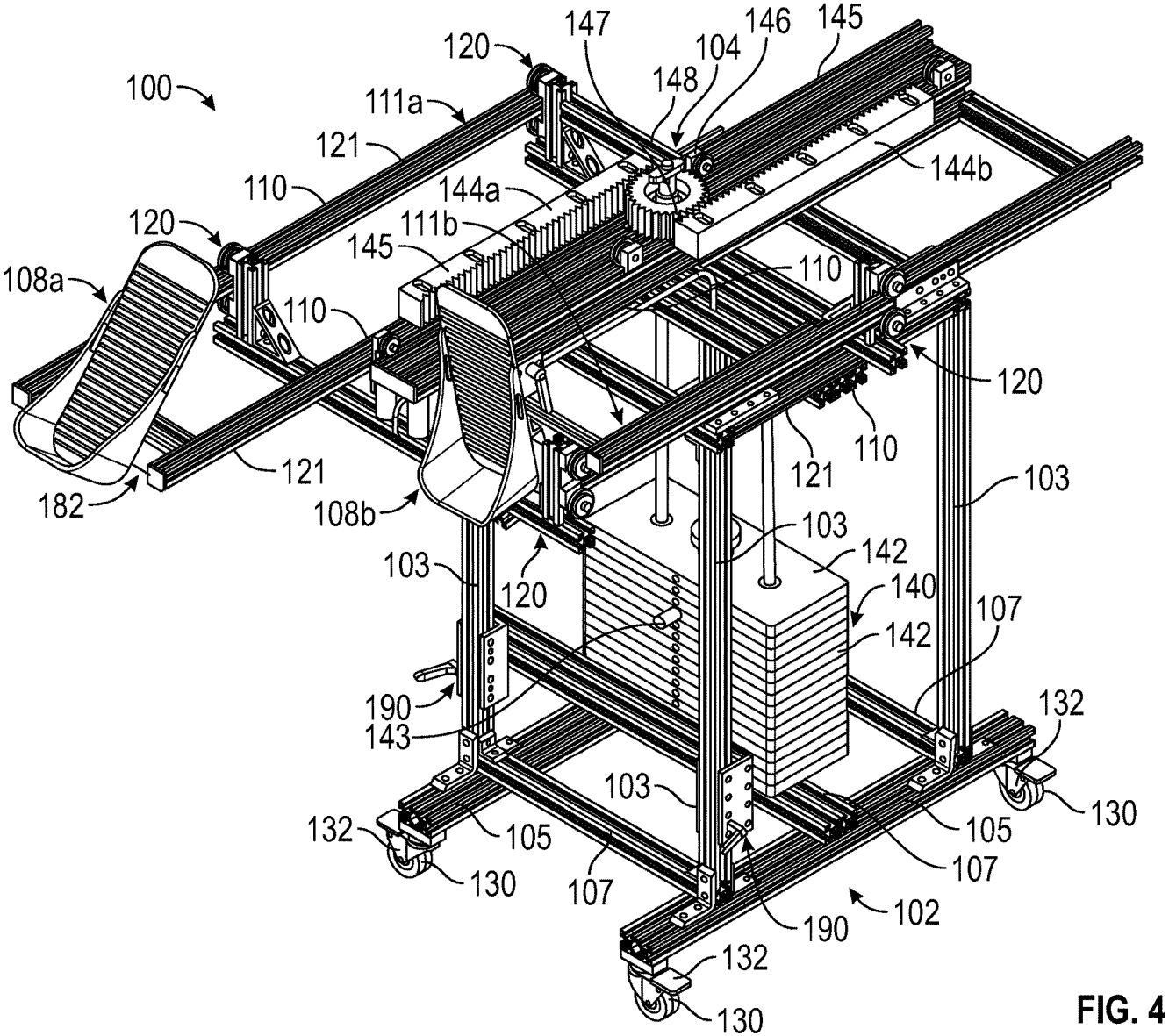
FIG. 4 is another perspective view of the supine stepper of FIG. 1.
Figure 6:
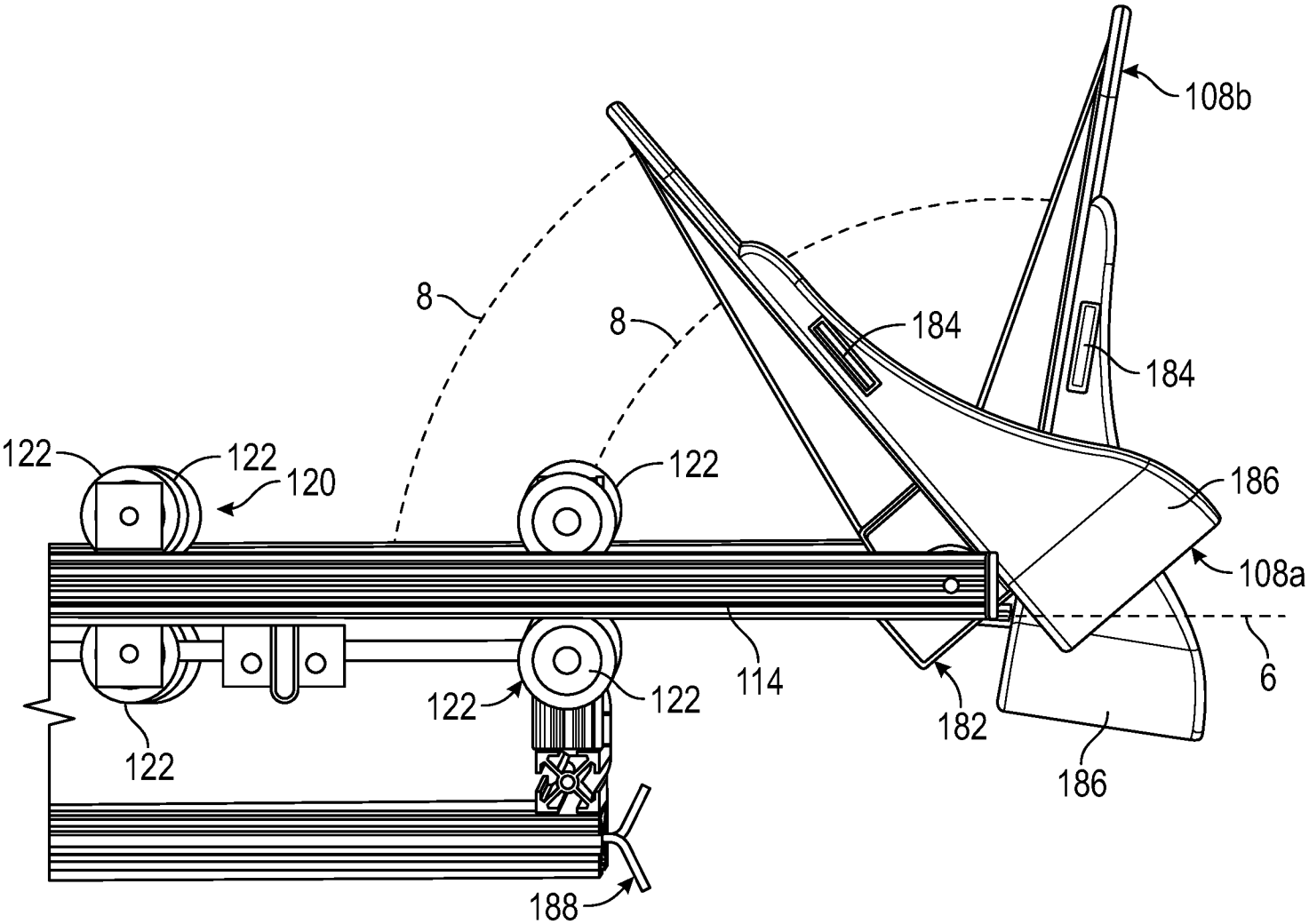
FIG. 6 is a side view of a portion of the supine stepper of FIG. 1.

According to various embodiments, the supine stepper 100 may include a securing member 188 (e.g., a clamp, a loop with hook and loop fasteners, a loop with a button, etc.) coupled to the platform 112 (see e.g., FIGS. 3 and 6). The securing member 188 is configured to couple the supine stepper 100 to another structure (e.g., a bed, a bedframe, etc.). The securing member 188 is configured to transform between a securing and a non-securing orientation. In this sense, the securing member 188 may selectively help prevent the supine stepper 100 from rolling away from a patient while the supine stepper 100 is in use.

As shown, the supine stepper 100 further includes a plurality of height adjustment mechanisms 190. The height adjustment mechanisms 190 may be used to adjust a height of the supine stepper 100. According to various embodiments, the height is defined as a vertical distance between the horizontal plane 2 and a first track structure 111*a* and/or a second track structure 111*b*. The height adjustment mechanisms 190 are configured to transition from an unlocked orientation to a locked orientation. When the height adjustment mechanisms 190 are in the unlocked orientation, the platform 112 may be raised to increase the height of the supine stepper 100. For example, each of the vertical support structures 103 may include two or more telescoping support beams that enable the height of the supine stepper 100 to be adjusted. When the height adjustment mechanisms 190 are in the locked orientation, the height of the supine stepper 100 may be prevented from being adjusted.

As shown, the supine stepper 100 further includes a plurality of guides 120 coupled to the platform 112. Each of the guides 120 are configured to guide a track structure 111 along a track, as is discussed further herein. For example, the track structure 111 may translate through a respective guide 120 during use of the supine stepper 100. As shown, each guide 120 includes a plurality of guide wheels 122 (e.g., an upper guide wheel 122 and a lower guide wheel 122). The guide wheels 122 are configured to be received within a groove 121 of the respective track structure 111 such that the guide wheels 122 rotate within the groove as the track structure 111 translates through the guide 120. In this sense, the guide 120 causes the track structure 111 to translate in a substantially linear direction (e.g., along a track) within a track plane 6 during use of the supine stepper 100. It should be appreciated that other types of guides may be used to guide the track structures 111 along the respective track. For example, according to alternative embodiments, the guides may include rollers, slots, guide tubes, and/or any other type of guide mechanism configured to guide the track structures 111 along the tracks.

As discussed above, the supine stepper 100 includes a plurality of track structures 111. For example, the supine stepper 100 is shown to include a first track structure 111*a* and a second track structure 111*b*. The track structures 111 are coupled to the platform 112 via the guides 120 such that the track structures 111 are configured to translate along a track relative to the platform 112 and the base 102. The track structures 111 define a track plane 6 such that each of the track structures 111 translates along a track within the track plane 6. According to various embodiments, the track plane 6 is parallel to the horizontal plane 2 and/or the plane 4. According to various embodiments, the track plane 6 is substantially parallel (e.g., within 10 degrees, within 5 degrees, etc.) to the horizontal plane 2 and/or the plane 4. As shown, the first track structure 111*a* and the second track structure 111*b* are parallel to each other and translate parallel to each other (e.g., when viewed from the top) within the track plane 6. However, according to other embodiments, the first track structure 111*a* and the second track structure 111*b* may be angled towards or away from another. Further, according to some embodiments, the angular position of the first track structure 111*a* and the second track structure 111*b* may be adjusted as needed.

As shown, each of the track structures 111 include a plurality of horizontal support beams 110. As shown, the horizontal support beams 110 are positioned within the track plane 6 and are parallel, or substantially parallel (e.g., within 10 degrees, within 5 degrees, etc.), to the horizontal plane 2. Further, each of the horizontal support beams 110 includes a plurality of grooves 121 (e.g., an upper groove 121 and a lower groove 121) configured to receive a guide wheels 122 such that the guide wheels 122 guide the horizontal support beams 110 along the track.

According to various embodiments, the supine stepper 100 further includes a reciprocating mechanism, shown as a rack and pinion mechanism 104, coupled to the first track structure 111*a* and the second track structure 111*b*. The reciprocating mechanism is configured to receive a force from the first track structure 111*a* and transfer the force to the second track structure 111*b* such that translation of the first force receiving member (e.g., the first pedal 108*a*) in a first direction causes the second force receiving member (e.g., the second pedal 108*b*) to translate in a second direction opposite the first direction. According to various embodiments, this reciprocal motion capability enables the weight of one leg to drive the other, such that debilitated patients can use the supine stepper 100 without overexertion. Further, according to various embodiments, the first direction and the second direction are parallel, or substantially parallel (e.g., within 10 degrees, within 5 degrees, etc.), to the horizontal plane 2.

As shown, the rack and pinion mechanism 104 includes a first engagement member 144*a*, a second engagement member 144*b*, and a gear 146 configured to engage the engagement members 144. The first engagement member 144*a* is coupled to the first track structure 111*a* and the second engagement member 144*b* is coupled to the second track structure 111*b* such that a force applied to the engagement members 144 is transferred to the respective track structure 111 and vice versa.

As shown, the engagement members 144 include a plurality of teeth 145 configured to engage a plurality of teeth 147 of the gear 146. Thus, as the first engagement member 144*a* translates in a first direction, the teeth 145 of the first engagement member 144*a* to drive the teeth 147 of the gear 146, thereby causing the gear 146 to rotate in a first direction. As the gear 146 rotates in a first direction, the teeth 147 of the gear 146 drive the teeth 145 of the second engagement member 144*b*, thereby causing the second engagement member 144*b* to translate in a second direction that is the opposite of the first direction. This interaction causes a reciprocating motion between the first track structure 111*a*, along with the first pedal 108*a*, and the second track structure 111*b*, along with the second pedal 108*b*. The reciprocating motion may, among other benefits, facilitate the return of each pedal 108 towards the patient when the supine stepper 100 is in use.

The rack and pinion mechanism 104 further includes a coupling mechanism 148 configured to removably couple the gear 146 of the rack and pinion mechanism 104 to the engagement members 144. For example, the coupling mechanism 148 may be adjusted (e.g., rotated) to unlock the gear 146 from the remainder of the supine stepper 100 such that the gear 146 may be removed. Once removed, the first engagement member 144*a* will no longer drive the second engagement member 144*b*, thereby allowing the first track structure 111*a*, along with the first pedal 108*a*, and the second track structure 111*b*, along with the second pedal 108*b*, to translate relative to the base 102 independently of one another, rather than translating in opposite directions.

According to various embodiments, the supine stepper 100 further includes a resistance mechanism, shown as a weight mechanism 140, configured to resist translation of the track structures 111 along the respective track in the track plane 6. For example, the weight mechanism 140 is shown to include a cable housing 151 that houses a cable coupled to at least one of the first track structure 111*a* and the second track structure 111*b*. Further, the cable is coupled to at least one of a plurality of weights 142. As the track structures 111 translate, the cable transfer the force for at least one weight 142, thereby causing the weight to translate vertically in a direction perpendicular to the horizontal plane 2. Thus, the force needed to overcome the gravitational force acting on the at least one weight 142 will resist the movement of the respective track structure 111. Further, the weight mechanism may facilitate the return of a pedal 108 towards the patent during use of the supine stepper 100. For example, the gravitation force acting on the weights 142 may cause the weights 142 to translate downward towards the horizontal plane 2, which may cause one of the pedals 108 to translate towards the patient using the supine stepper 100. Furthermore, it should be appreciated that the additional mass added by the plurality of weights 142 may help prevent the supine stepper 100 from rolling away from a user while the supine stepper 100 is in use.

According to various embodiments, the weight mechanism 140 includes a coupling member 143 configured to adjust the number of weights 142 coupled to the cable. For example, each weight 142 is shown to include an aperture 141 configured to receive the coupling member 143. Once inserted into an aperture 141 of a weight 142, the weight 142 and all of the weights 142 above the weight 142 may be coupled to at least one of the track structures 111, thereby enabling a user to adjust the resistance of the resistance mechanism. Further, according to various embodiments, if the coupling member 143 is remove from the aperture 141 and not inserted into another aperture, the weights 142 are decoupled from the track structures 111 such that the track structures 111 may translate independently of the weights 142.

Figure 5:
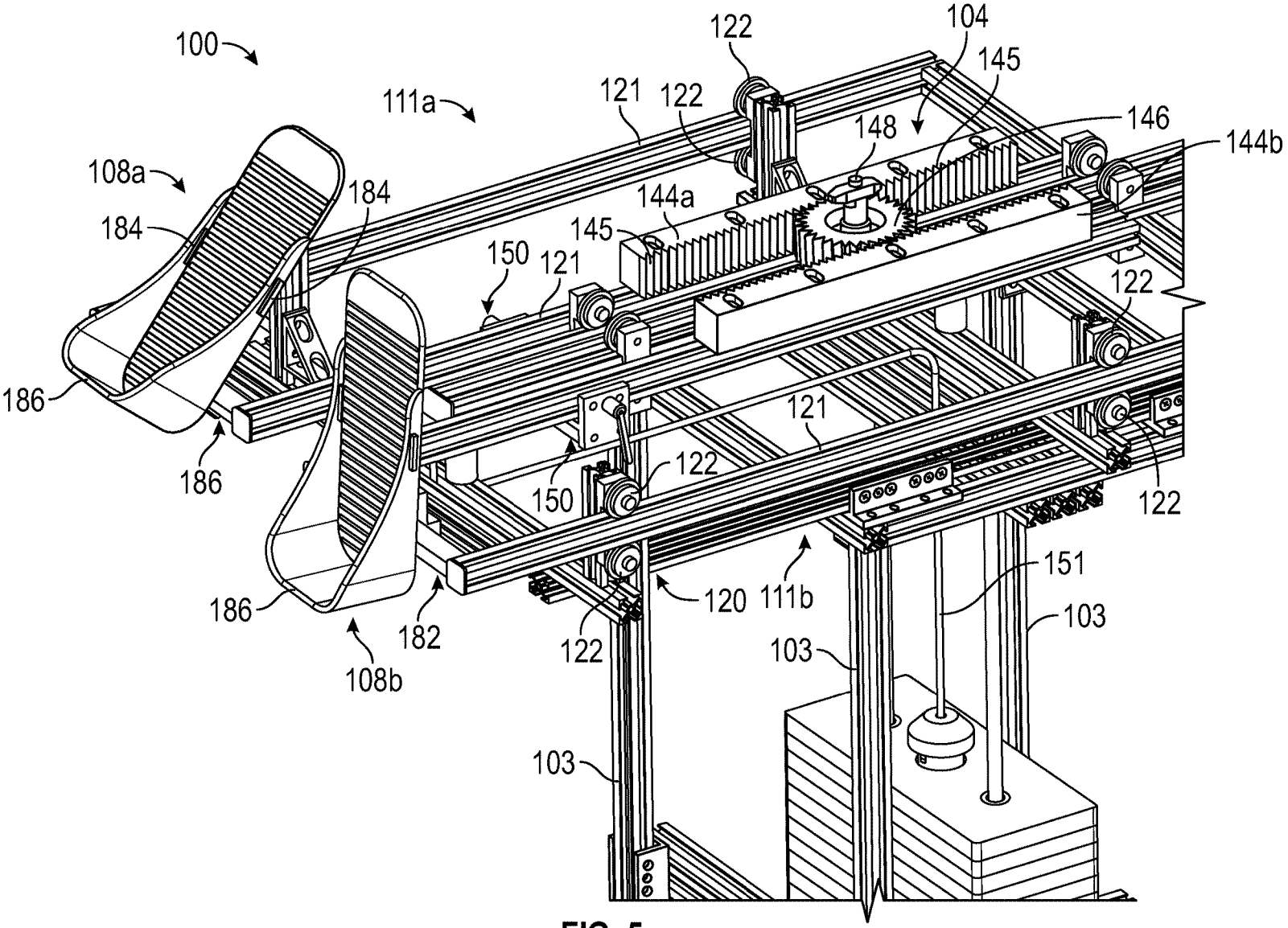
FIG. 5 is another perspective view of the supine stepper of FIG. 1.
Figure 7:
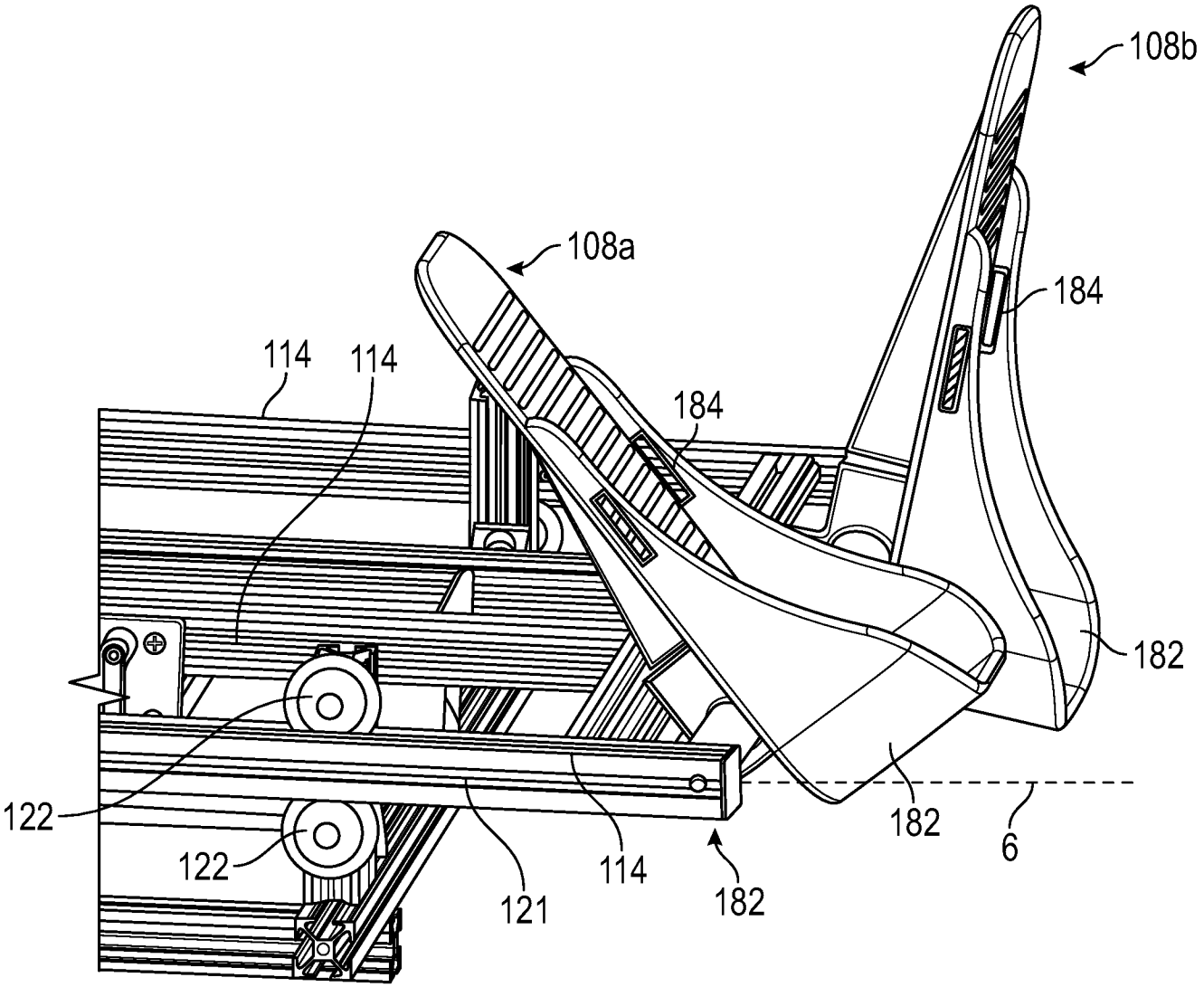
FIG. 7 is a perspective view of a portion of the supine stepper of FIG. 1.

Referring now to FIGS. 5-7, the supine stepper 100 further includes a plurality of force receiving members, shown as pedals 108, coupled to the track structures 111. For example, the supine stepper 100 is shown to include a first pedal 108*a* and a second pedal 108*b*. The force receiving members are configured to receive a force from a user of the supine stepper 100 and transfer that force to the track structures 111 such that the track structures 111 translate horizontally (e.g., within the track plane 6). The pedals 108 extend away from an the platform 112 in a cantilevered arrangement so that the pedals 108 can extend toward a patient lying on a bed when the base 102 is positioned on a floor surface adjacent to the bed. In some embodiments, the position of the pedals 108 (e.g., extension, separation, etc.) with respect to the base 102 and with respect to each other may be adjustable, as is discussed further herein. While the example embodiment shows the force receiving members as pedals 108, it should be appreciated that other types of force receiving members (e.g., handles) may be included in alternative embodiments.

The first pedal 108*a* and the second pedal 108*b* are shown to include a protrusion 186 proximate a bottom portion of the pedals 108. The protrusion 186 is configured to prevent a user's foot from slipping off the pedal. Further, each pedal 108 is shown to include apertures on the sides of the pedals 108. The apertures 184 are configured to receive a retention member (e.g., a strap, a loop, etc.) such that a user's foot may be further secured to the pedal 108 using the retention member.

As best shown in FIGS. 3 and 6, each of the pedals 108 includes a pivot member 182 coupled to the track structure 111 and configured to allow rotation of the pedal 108 about the pivot member 182 to adjust a pedal angle 8. The pedal angle 8 is defined by the angle between the track plane 6 and the pedal 108. According to various embodiments, the pivot member 182 may limit rotation of each pedal 108 between a predetermined maximum pedal angle 8 (e.g., the pedal angle 8 of the second pedal 108*b* shown in FIGS. 6 and 7) and a predetermined minimum pedal angle 8 (e.g., the pedal angle 8 of the first pedal 108*a* shown in FIGS. 6 and 7).

According to various embodiments, the pivot member 182 may also include a biasing mechanism (e.g., a spring) configured to bias the pedal 108 to a predetermined position. For example, the biasing mechanism may bias the pedal 108 to the maximum pedal angle 8, thereby providing additional resistance as a user flexes his or her foot during use of the supine stepper 100.

Figure 8:
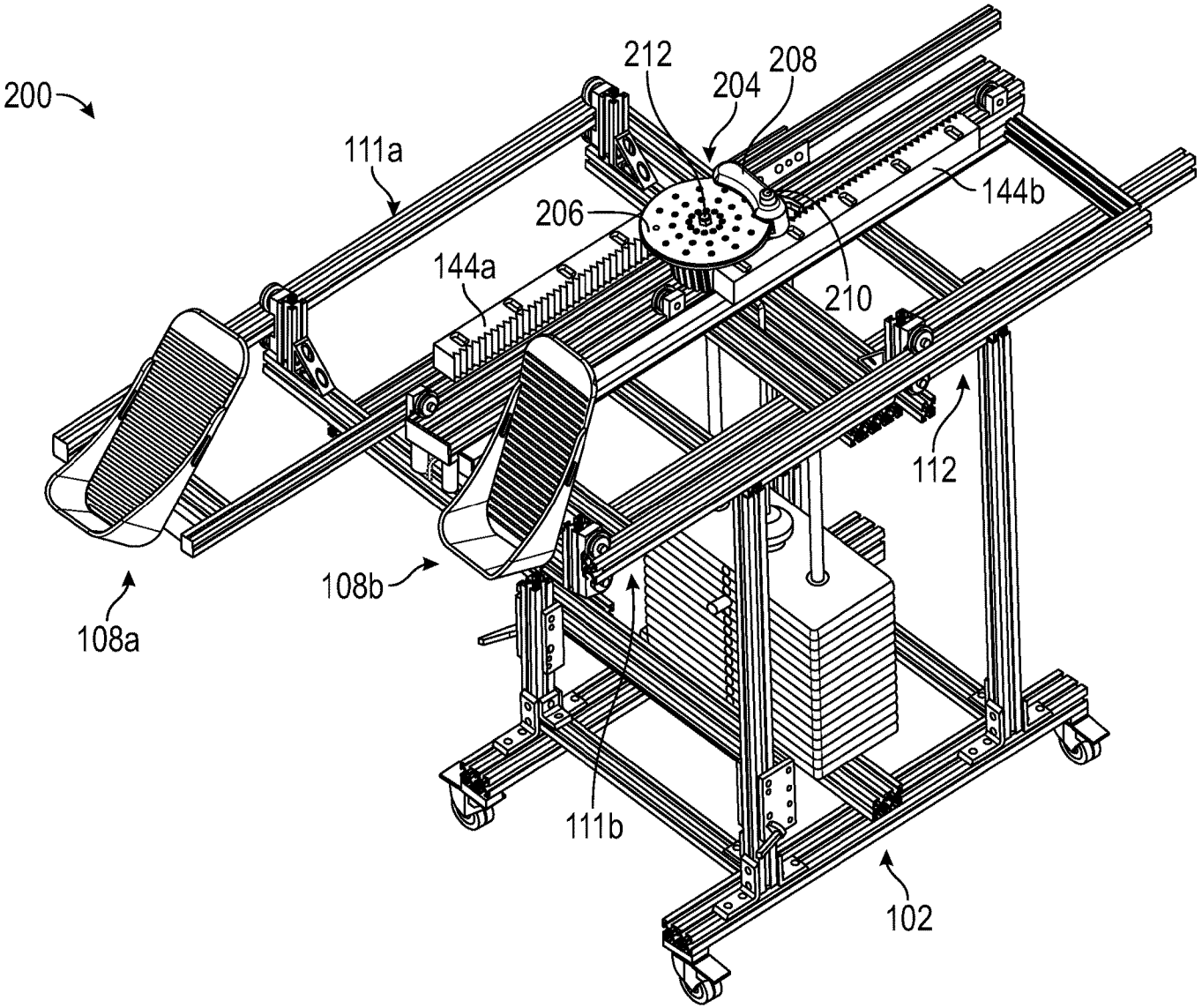
FIG. 8 is a perspective view of another supine stepper, according to an embodiment.
Figure 9:
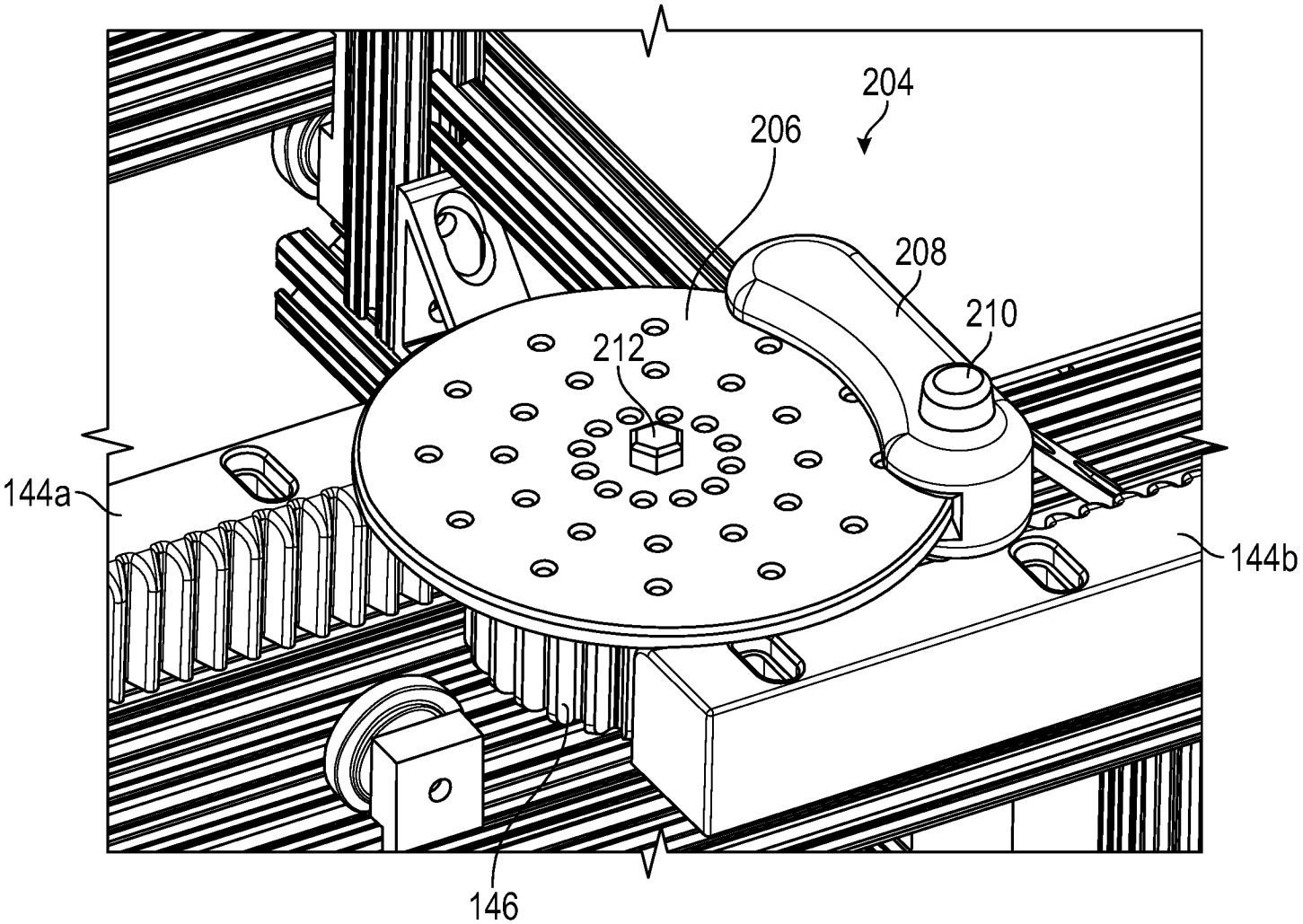
FIG. 9 is a perspective view of a portion of the supine stepper of FIG. 8.

Referring now to FIGS. 8 and 9, a supine stepper 200 is shown according to an alternative embodiment. The supine stepper 200 may include some or all of the same components as the supine stepper 100 described above. For example, the supine stepper 200 includes a first pedal 108*a* coupled to a first track structure 111*a* and a second pedal 108*b* coupled to a second track structure 111*b*. However, the supine stepper 200 further includes an additional resistance mechanism 204 configured to resist translation of the first track structure 111*a* and the second track structure 111*b* along the first track and the second track, respectively.

The resistance mechanism 204 includes a brake mechanism comprising a disc 206 and a caliper 208, and an adjustment mechanism 210. As shown, the disc 206 is coupled to the gear 146 via a fastener 212 such that the disc 206 rotates as the gear 146 rotates (e.g., in response to being driven by one of the engagement members 144). The caliper 208 is configured to engage the disc 206 as the disc 206 rotates to resist the rotation of the disc 206. For example, the caliper 208 may include a brake pad configured to apply a breaking force to the disc 206. Thus, as a patient applies a force to at least one of the pedals 108, at least one track structure 111 will translate relative to the base 102, thereby causing the disc 206 to spin, and the caliper 208 will apply a braking force to the disc 206 to resist the translation of the track structure 111 to provide additional resistance for the patient.

According to various embodiments, the resistance mechanism 204 includes an adjustment mechanism 210 configured to adjust the braking force applied by the caliper 208 to the disc 206. For example, manipulation (e.g., rotation) of the adjustment mechanism 210 may increase or decrease the pressure applied by the brake pad to the disc 206, thereby adjusting the braking force and the resistance of the resistance mechanism 204.

Figure 10:
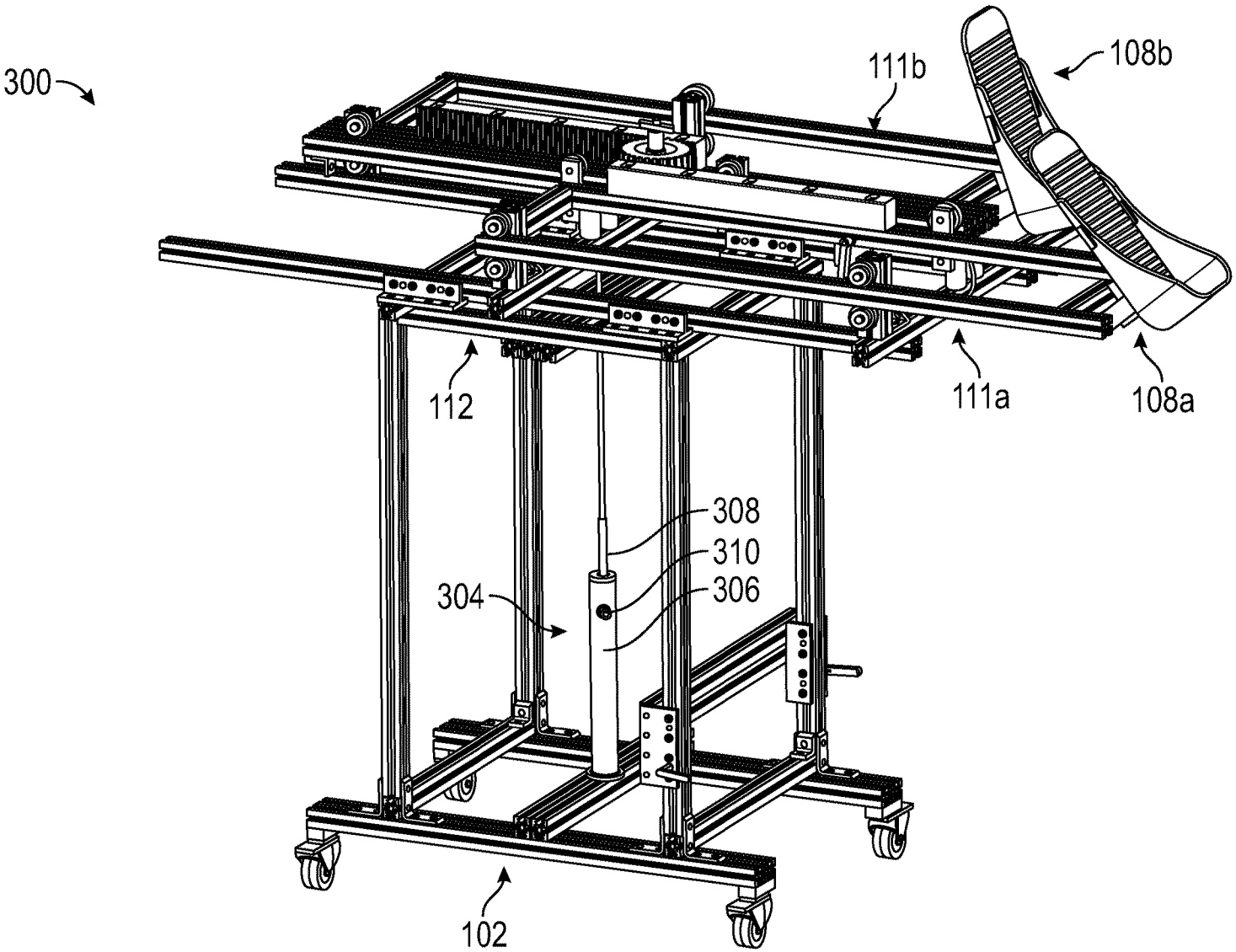
FIG. 10 is a perspective view of another supine stepper, according to an embodiment.
Figure 11:
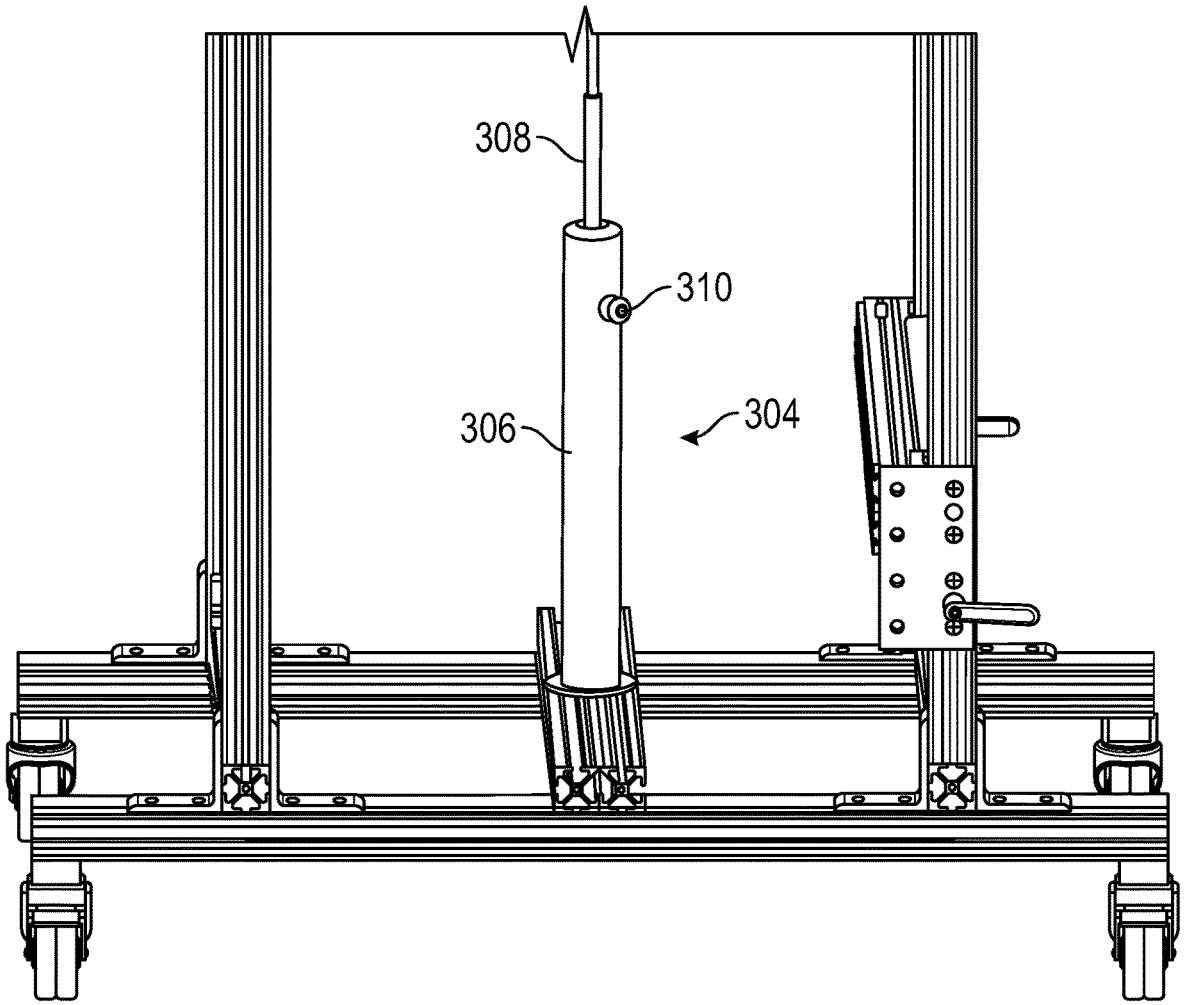
FIG. 11 is a perspective view of a portion of the supine stepper of FIG. 10.

Referring now to FIGS. 10 and 11, a supine stepper 300 is shown according to an alternative embodiment. The supine stepper 300 may include some or all of the same components as the supine stepper 100 described above. For example, the supine stepper 200 includes a first pedal 108*a* coupled to a first track structure 111*a* and a second pedal 108*b* coupled to a second track structure 111*b*. However, the supine stepper 300 further includes an alternative resistance mechanism 304 configured to resist translation of the first track structure 111*a* and the second track structure 111*b* along the first track and the second track, respectively.

The resistance mechanism 304 includes a hydraulic cylinder mechanism comprising a housing 306 and a shaft 308 coupled to a valve positioned within the housing 306, and an adjustment mechanism 310. The shaft 308 is coupled to at least one of the first track structure 111*a* and the second track structure 111*b* such that translation of the track structure 111 along the respective track causes movement of the shaft 308 (e.g., vertical translation, rotation, etc.). As the shaft moves, the valve positioned within the housing 306 also moves within the housing 306. According to various embodiments, a fluid (e.g., gas, liquid, etc.) resists the movement of the valve within the housing 306, thereby resulting in a resistive force. Thus, as a patient applies a force to at least one of the pedals 108, at least one track structure 111 will translate relative to the base 102, thereby causing movement of the shaft 308 and the fluid within the housing will resist the movement of the valve to resist the translation of the track structure 111 to provide additional resistance for the patient.

According to various embodiments, the resistance mechanism 304 includes an adjustment mechanism 310 configured to adjust the resistive force applied to the shaft. For example, manipulation (e.g., rotation) of the adjustment mechanism 310 may increase or decrease the size of an opening in the valve, thereby adjusting the resistance of the resistance mechanism 304.

Figure 12:
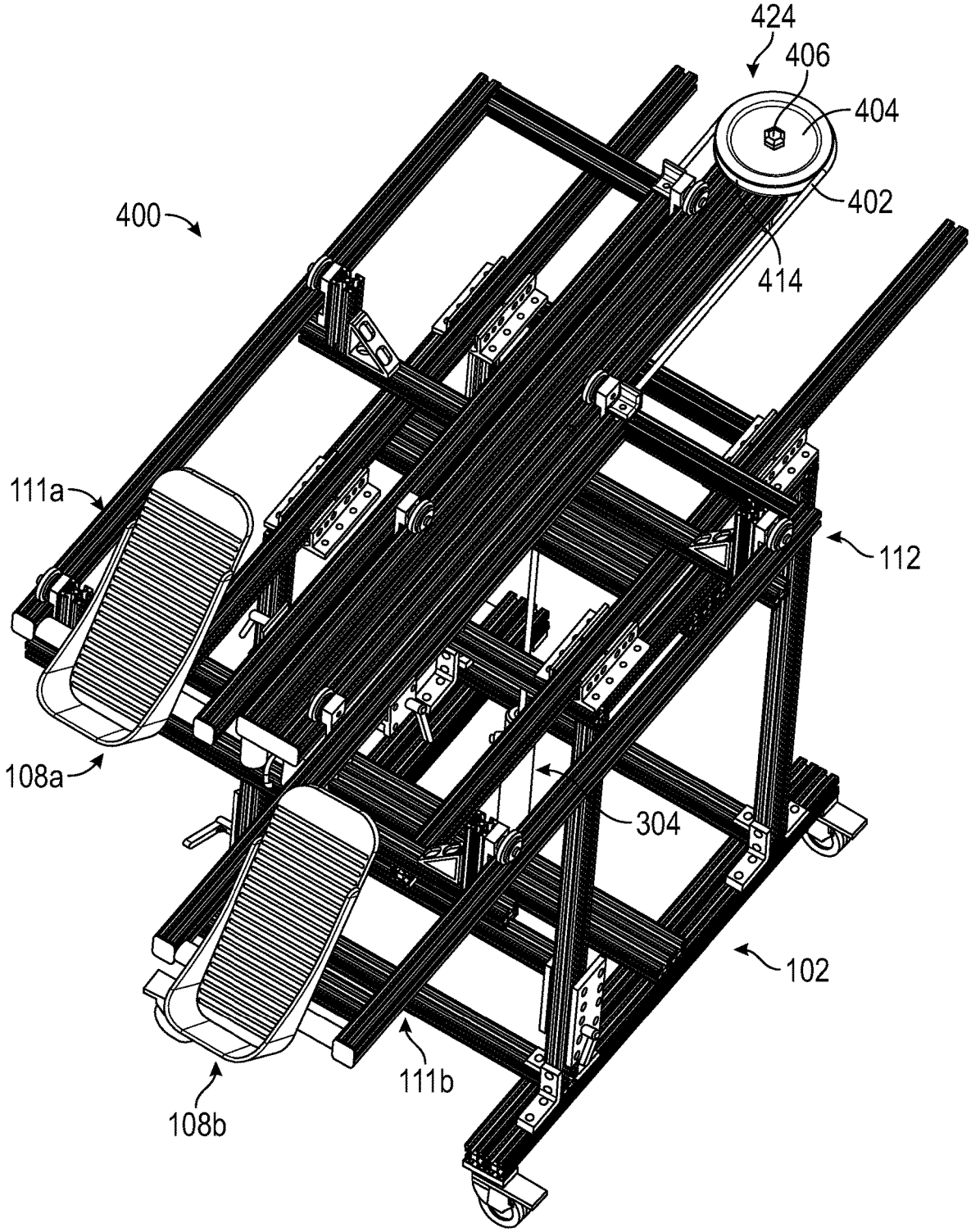
FIG. 12 is a perspective view of another supine stepper, according to an embodiment.
Figure 13:
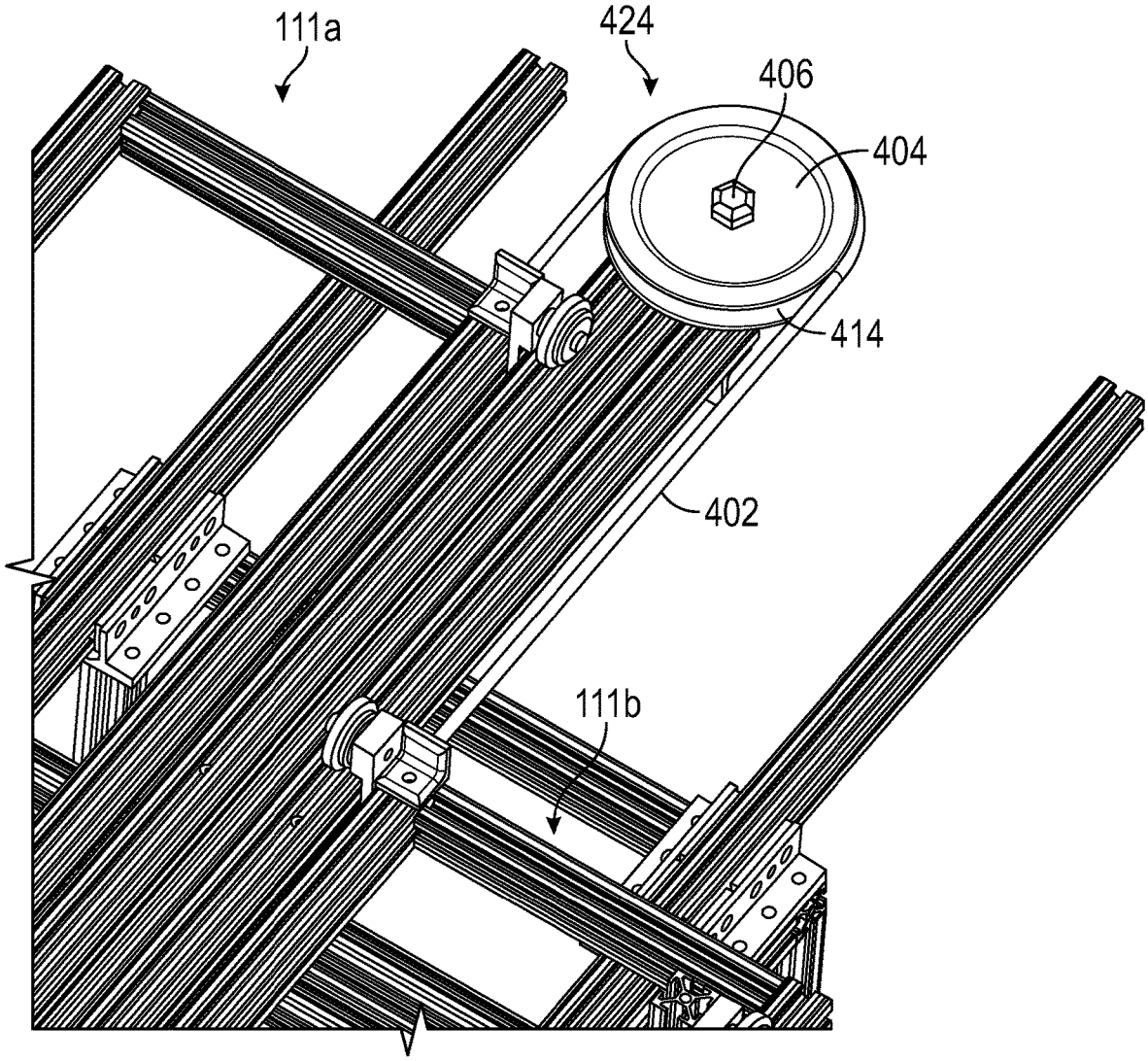
FIG. 13 is a perspective view of a portion of the supine stepper of FIG. 12.

Referring now to FIGS. 12 and 13, a supine stepper 400 is shown according to an alternative embodiment. The supine stepper 400 may include some or all of the same components as the supine stepper 300 described above. For example, the supine stepper 400 includes a first pedal 108*a* coupled to a first track structure 111*a*, a second pedal 108*b* coupled to a second track structure 111*b*, and a resistance mechanism 304. However, the supine stepper 400 further includes an alternative reciprocating mechanism, shown as a pulley mechanism 424, configured to enable reciprocal motion of first track structure 111*a* and the second track structure 111*b* along the first track and the second track, respectively.

The pulley mechanism 424 includes a line 402, a wheel 404, and a fastener 406 configured to couple the wheel 404 to the supine stepper 400. The line 402 is coupled to the first track structure 111*a* and the second track structure 111*b* such that the first track structure 111*a* is coupled to the second track structure 111*b* via the line 402. The wheel 404 includes a groove 414 configured to receive a portion of the line 402.

When a patient applies a force to the first pedal 108*a*, the first pedal 108*a* and the first track structure 111*a* will translate in a first direction. The force is then transferred via the line 402 (e.g., as a result of rotation of the wheel 404 about the fastener 408) to the second track structure 111*b* and the second pedal 108*b*, thereby causing the second track structure 111*b* and the second pedal 108*b* to translate in a second direction that is opposite the first direction.

According to various embodiments, the line 402 is substantially inelastic (e.g., does not stretch more than 5% of the overall length in response to forces experienced as a component of the supine stepper 400), thereby reducing the amount of slack in the line 402 during use. Further, according to various embodiments, the line 402 is substantially rigid such that the line 402 may apply a pushing force to the track structures 111 to cause reciprocating motion of the pedals 108.

As utilized herein with respect to numerical ranges, the terms "approximately," "about," "substantially," and similar terms generally mean +/−10% of the disclosed values. When the terms "approximately," "about," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the supine stepper as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

The invention claimed is:

1. A stepper, comprising:

a base defining a horizontal plane;

a first track structure coupled to the base and configured to translate along a first track;

a first force receiving member coupled to the first track structure;

a second track structure coupled to the base and configured to translate along a second track;

a second force receiving member coupled to the second track structure;

a reciprocating mechanism configured to selectively i) couple the first track structure and the second track structure in a first configuration such that translation of the first force receiving member in a first direction causes the second force receiving member to translate in a second direction opposite the first direction, and ii) decouple the first track structure and the second track structure in a second configuration such that translation of the first force receiving member in the first direction does not cause the second force receiving member to translate in the second direction opposite the first direction; and a height adjuster configured to adjust a height, wherein a vertical distance between the first track structure and a ground defines the height.

2. The stepper of claim 1, wherein the reciprocating mechanism includes a rack and pinion mechanism.

3. The stepper of claim 2, wherein the rack and pinion mechanism includes a first engagement member coupled to the first track structure, a second engagement member coupled to the second track structure, and a gear coupled to the first engagement member and the second engagement member.

4. The stepper of claim 3, further comprising a brake mechanism coupled to the reciprocating mechanism and configured to selectively provide a braking force to resist the translation of the first track structure and the second track structure.

5. The stepper of claim 4, wherein the brake mechanism includes an adjustment mechanism configured to adjust the braking force.

6. The stepper of claim 1, further comprising a securing member coupled to the base and configured to attach the base to a structure.

7. The stepper of claim 6, wherein the structure includes a bed.

8. The stepper of claim 1, further comprising a weight mechanism including at least one weight, wherein the weight mechanism is coupled to at least one of the first track structure and the second track structure such that the translation of at least one of the first force receiving member and the second force receiving member causes movement of the at least one weight in a direction perpendicular to the horizontal plane.

9. The stepper of claim 8, wherein the weight mechanism is selectively coupled to at least one of the first force receiving member and the second force receiving member and the weight mechanism includes a coupling member, wherein the coupling member is configured to selectively couple the at least one weight to at least one of the first track structure and the second track structure.

10. The stepper of claim 1, wherein the first force receiving member is rotatably coupled to the first track structure to allow for the first force receiving member to rotate relative to the first track structure while the first force receiving member translates in the first direction and wherein the second force receiving member is rotatably coupled to a second track structure to allow for the second force receiving member to rotate relative to the second track structure while the second force receiving member translates in the second direction.

11. The stepper of claim 10, wherein the first force receiving member is configured to rotate between a predetermined maximum angle and a predetermined minimum angle.

12. The stepper of claim 1, wherein the first track and the second track are substantially parallel to the horizontal plane.

13. The stepper of claim 1, wherein the base is coupled to a plurality of wheels, at least one of the plurality of wheels includes a stopper configured to selectively engage and prevent rotation of the at least one of the plurality of wheels.

14. The stepper of claim 1, wherein the first force receiving member includes a first pedal and the second force receiving member includes a second pedal.

15. A method, comprising:

providing a base defining a horizontal plane;

coupling a first track structure to the base;

coupling a first force receiving member to the first track structure;

coupling a second track structure to the base;

coupling a second force receiving member to the second track structure;

coupling a reciprocating mechanism to the first track structure and the second track structure to cause the first track structure and the second track structure responsive to applying a force to either the first force receiving member or the second force receiving member;

decoupling the reciprocating mechanism from the first track structure or the second track structure to cause the first track structure to move independent to the second track structure responsive to applying a second force to the first force receiving member; and adjusting an angle of the first force receiving member between a predetermined maximum angle and a predetermined minimum angle.

16. The method of claim 15, wherein the reciprocating mechanism includes a rack and pinion mechanism.

17. The method of claim 16, wherein the reciprocating mechanism is coupled to a brake mechanism configured provide a braking force to resist translation of the first force receiving member and the second force receiving member.

18. The method of claim 15, further comprising coupling a weight to at least one of the first track structure and the second track structure such that translation of at least one of the first force receiving member and the second force receiving member causes movement of the weight in a direction perpendicular to the horizontal plane.

19. The method of claim 18, wherein the weight is selectively coupled to at least one of the first force receiving member and the second force receiving member, and wherein a coupling member is configured to selectively couple the weight to at least one of the first track structure and the second track structure.

20. The method of claim 15, wherein decoupling the reciprocating mechanism comprises decoupling the reciprocating mechanism from the base such that the first track structure translates independently of the second track structure.

21. A stepper, comprising:

a base defining a horizontal plane;

a first track structure coupled to the base and substantially parallel to the horizontal plane;

a first force receiving member coupled to the first track structure and configured to translate along the first track structure;

a second track structure coupled to the base and substantially parallel to the horizontal plane;

a second force receiving member coupled to the second track structure and configured to translate along the second track structure; and a weight coupled to at least one of the first force receiving member and the second force receiving member such that translation of at least one of the first force receiving member and the second force receiving member causes movement of the weight in a direction perpendicular to the horizontal plane.

* * * * *